340-552
1/26/88 XR 4,721,945

United States Patent [19]
Maki et al.

[11] Patent Number: 4,721,945
[45] Date of Patent: Jan. 26, 1988

[54] SIMULATED TARGETS FOR DETECTION SYSTEMS

[75] Inventors: Melvin C. Maki, Kanata; Roger G. Pither, Nepean; James H. Chalmers, Kanata, all of Canada

[73] Assignee: 501 Control Data Canada Limited, Ottowa, Canada

[21] Appl. No.: 798,084

[22] Filed: Nov. 14, 1985

[30] Foreign Application Priority Data

Nov. 19, 1984 [CA] Canada ..... 468141

[51] Int. Cl.[4] ..... G08B 29/00
[52] U.S. Cl. ..... 340/515; 340/514; 340/551; 340/552; 340/561; 340/565
[58] Field of Search ..... 340/515, 500, 514, 540, 340/541, 561, 551–554, 596–598, 601, 565; 324/51, 52, 72, 74

[56] References Cited

U.S. PATENT DOCUMENTS

| | | | |
|---|---|---|---|
| 3,022,496 | 2/1962 | Bagno | 340/515 |
| 3,189,883 | 6/1965 | Lucas et al. | 340/515 |
| 3,794,992 | 2/1974 | Gehman | 340/552 |
| 3,851,301 | 11/1974 | Demers et al. | 340/515 |
| 3,976,868 | 8/1976 | Lane | 340/515 |
| 4,053,877 | 10/1977 | Torlesse et al. | 340/552 |
| 4,386,343 | 5/1983 | Shiveley | 340/515 |

FOREIGN PATENT DOCUMENTS

| | | |
|---|---|---|
| 843033 | 5/1970 | Canada . |
| 1002597 | 12/1976 | Canada . |
| 1110341 | 10/1981 | Canada . |
| 1145828 | 5/1983 | Canada . |

*Primary Examiner*—Donnie L. Crosland
*Attorney, Agent, or Firm*—Jones, Tullar & Cooper

[57] ABSTRACT

A simulated target for use in conjunction with detection systems using coupled transmission lines. The simulated target is positioned in the vicinity of the transmission line and the response used both to monitor system operation and to calibrate system response levels. The simulated target can be of a type having its electrical length variable under system control or can be purely passive serving to alter the stationary response profile of the system.

20 Claims, 5 Drawing Figures

SIMULATED TARGETS FOR DETECTION SYSTEMS

The present invention relates to a simulated target for use with intrusion detection systems of the type using coupled transmission lines. The simulated target is used for monitoring system operation and aiding in calibrating system response.

Such perimeter intrusion detection systems are shown in applicant's U.S. Pat. Nos. 4,091,367, issued May 23, 1978 and 4,419,659 issued Dec. 6, 1983. The former patent describes a long-line system using RF coupling between two radiating co-axial cables for intrusion detection, whereas the latter patent utilizes coupling between an antenna and at least one radiating coaxial cable. Other open-wire transmission lines have also been employed for such functions.

All such systems exhibit a sensitivity to the installation medium in their vicinity, and to changes in this medium. For example sensors buried near the surface of the earth exhibit changes in signal return after prolonged rain or ground freezing.

It is the object of the present invention to provide a simulated target located in the vicinity of the cable sensor to assist in both the calibration and performance monitoring of such systems in order to ensure satisfactory long term performance. Typically, calibration requires a method of regularly setting and/or checking system thresholds to ensure a potential intruder would be detected anywhere along the sensor length. These thresholds can vary either with natural changes in the medium adjacent to the sensors, such as is associated with freezing and thawing of soil, or due to man-made disturbances of the environment within or nearby the detection zone.

A standard method of calibration is periodically to have a person acting as an intruder move along the sensor length within the detection zone. During this operation a processor computes the thresholds required to detect the intruder for each position along the sensor. This technique is used for both pulse excited coupled line sensors where ranging information is available, and also for continuous wave sensors which typically provide ranging information only when deployed in discrete blocks. The problem with this technique is that it requires expensive trained manual labor; it is difficult to determine exactly where the detection zone of such a covert buried sensor is, and it provides no foreknowledge of when such calibration is needed.

Performance monitoring is required to ensure the system is functioning correctly. Typically, unless intruders are both present and detected there is no evidence that the system is operational. This is usually checked periodically by a calibration walk as described above, or by simulated intrusions. Again, being labor intensive, these techniques are expensive to perform regularly.

Other types of performance assessment devices exist, such as described in Canadian Pat. No. 1,002,597 issued Dec. 28, 1976 to Enabit. This patent describes a point inductive loop device for use in performance monitoring and verification of a known environment. The invention herein pertains to a transmission line device distributed along a sensor for use in system calibration relative to a changing environment. Similarly, Canadian Pat. No. 1,110,341, issued Oct. 6, 1981, discloses use of a periodically energized target in a store article checking system which utilizes dipoles which re-radiate at a frequency different from the primary exciting frequencies.

SUMMARY OF THE INVENTION

The invention described herein is used in combination with an intrusion detection system having at least one coupled transmission line. A simulated target consisting of a conductor is located in the near field of the cable and means are provided for altering the electrical length of the conductor so that in one configuration it provides a response similar in magnitude to that provided by a target which the system is designed to detect.

In another aspect, the invention is used in combination with an intrusion detection system having at least one transmission line and providing a stationary response profile in the absence of a target. A simulated target consisting of a conductor of such length as to provide a detectable response at the frequency of the system is located in the near field of the transmission line so as to alter the response profile, whereby changes in ambient conditions can be detected.

The advantages of the invention will become apparent from the following description of preferred embodiments taken in conjunction with the accompanying drawings in which.

DESCRIPTION OF THE PREFERRED EMBODIMENT

Figure 1:
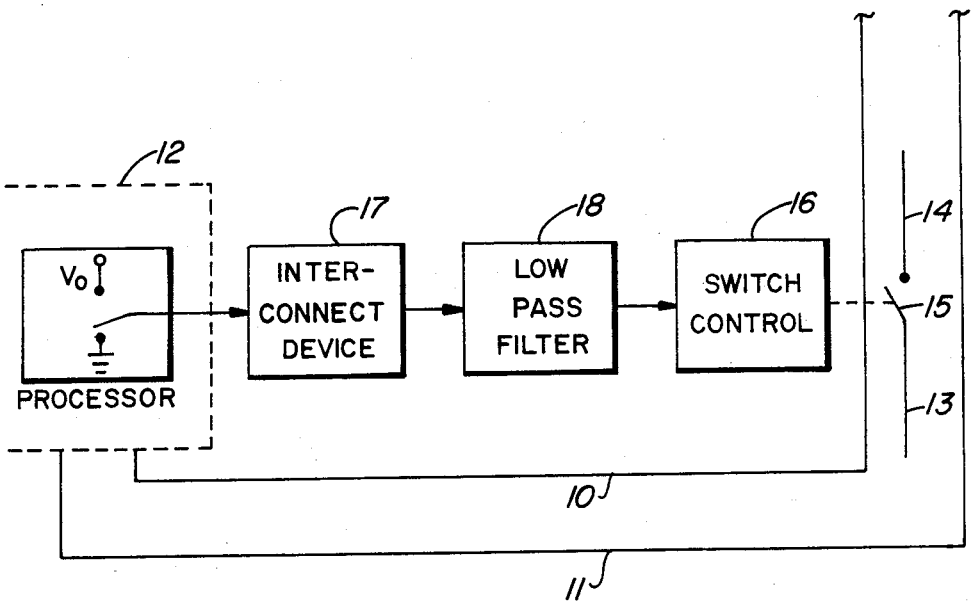
FIG. 1 is a block diagram of a system including a simulated target having a variable electrical length.

FIG. 1 shows a known intrusion detection system consisting of radiating coaxial cables 10 and 11 controlled by a central processor 12. A simulated target consisting of conductor sections 13 and 14 is positioned in the near field of the coaxial cables. The electrical characteristics of the simulated target can be altered by actuating switch 15 to connect the conductor sections together. Switch control 16 is actuated by processor 12 through an interconnection device 17 and a low pass filter 18 which prevents RF propagation between the cables and the processor.

It will be clear to one skilled in the art that switch 15 could be actuated by other means such as a signal sent along one of cables 10 and 11 and would thus require no separate link to the central processor 12.

Figure 2:
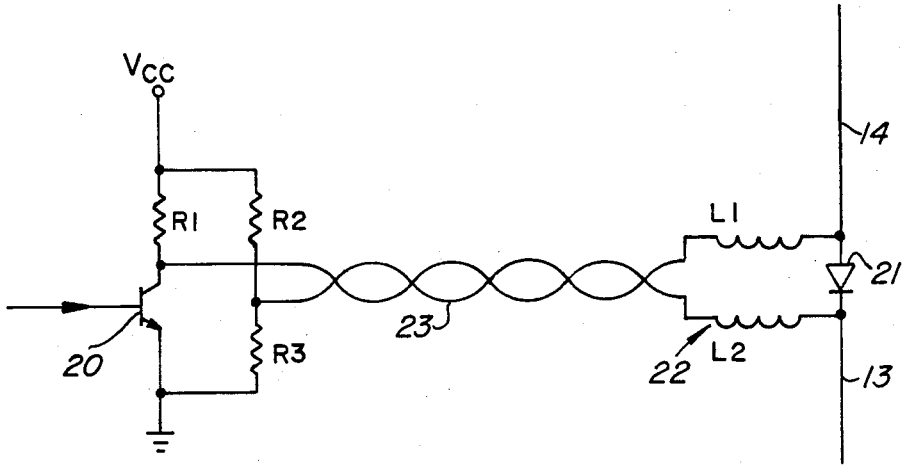
FIG. 2 is a schematic diagram of a circuit useful in the system of FIG. 1.

A particular form of such a remotely actuated simulated target is shown in FIG. 2. A transistor 20, at the processor can switch a diode 21, located between conductors 13 and 14 from the non-conducting to the conducting state. Conductors 13 and 14 are selected each to be of length equal to one quarter wavelength at the frequency of operation. The switching action in this case makes the two conductors appear as a single larger half wavelength target. Inductive chokes, ferrite beads, lossy conductors or similar means 22, provide radio frequency isolation of this target from the lead wires 23 connected to the processor 12. The change in the return signal received at the processor from the receive cable when the simulated target changes electrical length is then used as a measure of the detection sensitivity, from which thresholds can be adjusted. This operation is performed as required by the changing environment about the sensor. In addition, as a separate function the change in state can be used to simulate a target and exercise the system, in order to check that it is operational.

The resultant change due to switching of the simulated target is processed by the transceiver and processor. The magnitude, phase and location information of the signal return is then used in the processor, along with a defined algorithm for adjustment of sensor detection thresholds, or other parameters. For example if weather, e.g. rainfall, has altered the electrical characteristics of the burial medium and hence has altered the sensitivity of the sensor at some location, then this change can be sensed automatically by the switching of the simulated target and the detection thresholds can be adjusted accordingly without requiring human intervention.

The simulated target or targets are deployed within the detection zone of the sensor. For two buried radiating coaxial cables this is typically between or adjacent to the two cables and sufficiently buried in the soil both to be covert, and to be affected by the soil, in order to represent the degree of threshold changes required. The target length is selected to provide a response of magnitude similar to that of a typical target. The target need not resonate at the system frequency and may be selected to operate off resonance to provide a response of the desired magnitude. Locations along the sensor length may be selected to be in burial media that are representative, for example, of either the average or worst case in terms of sensor sensitivity, dependent on the threshold algorithm employed. Typically, but not necessarily, the number of targets chosen to be deployed along the sensor length would be comparable to the number of thresholds available. For example, a pulse system with 33 m. detection cells might have one target located every 33 m. while a continuous wave system using 150 m. cable segments may have only a single one per cable segment.

The advantages of this electrically alterable simulated target are:

(a) Calibration can be totally automated and performed under remote control, precluding the requirement for an operator at the site.

(b) Sensitivity of the system can be continuously monitored to assess performance and such monitoring can be done automatically.

(c) More timely calibration can be performed with thresholds adusted only when the need requires, resulting in better sensor performance, and reduced manpower.

Figure 3:
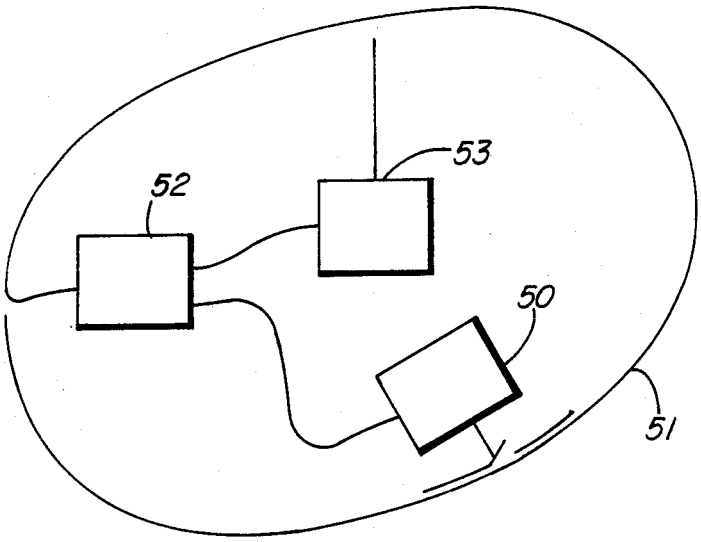
FIG. 3 shows a system having an array of passive elements used as simulated targets.

Other configurations of intrusion detection systems using a simulated target can be employed. FIG. 3 shows a simulated target used in conjunction with a radiating cable/antenna detection system. A target 50 is located near a radiating cable 51 and is remotely actuated by a processor/transceiver 52, altering the signal coupled between an antenna 53 and the radiating coaxial cable.

The present invention also extends the use of a passive simulated target, that is, one which is not switched. In a typical ranging coupled line detection system the signal return in the absence of a target, termed profile, varies in a random fashion (but constant in time) along the sensor length. This coupled signal consists of the raw coupling through the medium between the transmit and receive sensor elements plus reflections due to local discontinuities in the medium. Since this medium response is relatively constant with time, the profile can be separate from the response of a moving target.

The present invention controls and makes further use of this profile information. The profile response is altered by permanently situating along the sensor legth passive conductors which, typically, are approximately one half wavelength ($\lambda/2$) at the frequency of operation having regard to the particular burial material. These passive targets provide markers, producing a particular profile response corresponding to the location at which they are installed. These conductors are of a size and location to provide variations at least comparable with normal response variations due to discontinuities in the medium. If more than one conductor is used, they are spaced so as to provide acceptable overall response.

Figure 4:
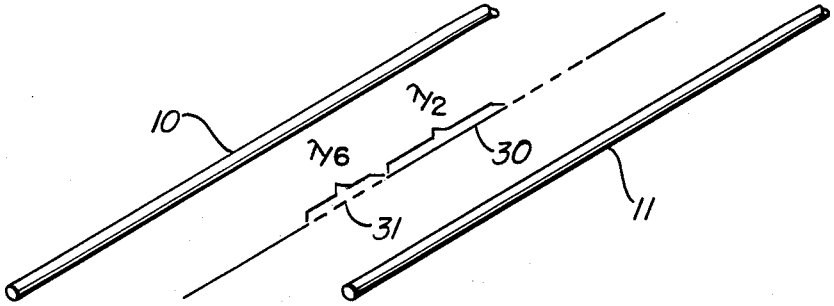
FIG. 4 shows a coaxial cable having passive target elements attached thereto.

Such passive simulated targets are shown in FIG. 4. An array of conductors 30 is placed near the cables 10 and 11 at a predefined spacing 31 from one another. Parameters such as the conductivity, diameter, lengths and spacings of the sections are selected to optimize the magnitude, phase and frequency characteristics of the response. It is useful to space a sequence of these conductors, parallel to the sensor and displaced from one another end to end such that the net profile response in a region of electrically uniform medium tends to cancel, whereas a change to any one or two adjacent targets produces a strong response. To achieve this result, the passive targets can be spaced at a regular non-integral number of wavelengths apart, as shown on FIG. 4.

The advantage of such a deployment is that if changes occur in the medium adjacent to a passive conductor over a length of approximately one-half lambda or greater, then a large detectable profile change becomes observable, indicating a need either for sensor re-calibration in this area or for the operator to investigate or assess the reason for the change.

Figure 5:
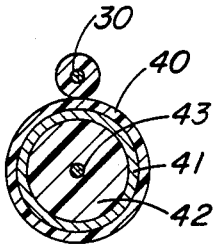
FIG. 5 shows an antenna/cable detection system including a simulated target.

FIG. 5 shows an embodiment in which the line of passive targets is built into the radiating coaxial cable. An auxiliary conductor 30 is fabricated in a manner similar to a coaxial cable messenger wire, as used for supporting cables aerially. Encircling the auxiliary conductor is the cable jacketing dielectric 40, applied over the coaxial cable shield 41, dielectric 42, and center conductor 43. To produce the appropriate lengths of the passive conductor 13, one can make longitudinal breaks, for example, at the points shown in FIG. 4, as the resultant short conductors ($\lambda/6$) are far from resonant in length.

A variation of the embodiment shown in FIG. 5 is to make the auxiliary conductor encircle the coaxial cable, as with a periodic metallic sleeve. This serves to increase the response from these simulated targets, since the impedance of the transmission line formed with the outer conductor of the leaky cable is reduced.

While preferred embodiments of the present invention have been illustrated and described it will be apparent to those skilled in the art that changes may be made without departing from the broader aspects of the invention.

We claim:

1. In combination, an RF intrusion detection system operating at a first RF frequency and having at least one RF transmission line with a radiating RF field therearound;

means responsive to said radiating RF field to provide a corresponding return signal;

a simulated target consisting of an electrical conductor having an effective electrical length located in said field, said simulated target being in the near field of said radiating RF field to thereby affect said return signal; and means in the intrusion system for altering the effective electrical length of the conductor so that at the altered effective electrical length said simulated target causes a change in said RF return signal which is similar to the change caused by an intruder entering said RF field.

2. The combination of claim 1 wherein said altered effective electrical length of the conductor is resonant at said first frequency.

3. The combination as set out in claim 1 wherein the conductor consists of at least two sections, and wherein said means for altering the effective length of the conductor consists of switch means.

4. The combination as set out in claim 1, wherein said change in said signal return is a change in magnitude.

5. The combination as set out in claim 1, wherein said change in said signal return is a change in phase.

6. The combination as set out in claim 1 or claim 2 wherein the transmission line and the conductor are buried in a medium having varying electrical characteristics.

7. The combination as set out in claim 1, claim 2 or claim 3 wherein the transmission line is a radiating coaxial cable.

8. The combination as set out in claim 1, claim 2 or claim 3 wherein the conductor is supported on the outside of the transmission line.

9. In combination with an RF intrusion detection system for detection of targets, the system operating at a first frequency and having at least one transmission line with a radiating RF field therearound and means responsive to said RF field to provide a return signal having a stationary response profile in the absence of a target, a simulated target consisting of electrical conductor means located in said RF field, said conductor means producing predetermined markers in said return signal response profile, whereby changes in ambient conditions will produce detectable variations in said return signal.

10. The combination as set out in claim 9, wherein said conductor means includes a plurality of passive conductors longitudinally spaced from one another along the length of the transmission line.

11. The combination as set out in claim 10 wherein said conductors are supported on the outside of the transmission line.

12. The combination as set out in claim 9 wherein the conductor means is resonant at said frequency.

13. The combination as set out in claim 9, claim 10 or claim 8, wherein the transmission line is a radiating coaxial cable.

14. The combination as set out in claim 9, claim 10 or claim 8, wherein the transmission line is a radiating coaxial cable and said conductors are conductive sleeves around the cable.

15. The combination as set out in claim 9, claim 10 or claim 8, wherein the transmission line and conductors are buried in a medium having varying electrical characteristics.

16. In an RF intrusion detection system operating at a first RF frequency, at least one transmission line radiating an RF field into a detection zone;

means responsive to said radiated RF field to provide a return signal having a stationary RF response profile in the absence of a target in said detection zone; and a simulated target consisting of electrical conductor means having known effective electrical characteristics located in said detection zone to produce predetermined markers in said return signal response profile.

17. The intrusion detection system of claim 16, wherein said simulated target includes a plurality of passive conductors for producing said markers in said response profile, whereby changes in ambient conditions produce detectable variations in said return signal.

18. The intrusion detection system of claim 16, further including means for changing the effective electrical characteristics of said simulated target to produce a change in said response profile which is similar to the change produced by an intruder entering said detection zone.

19. The intrusion detection system of claim 18, wherein said simulated target is located in the near field of said transmission line.

20. The intrusion detection system of claim 19, wherein said means for changing the effective electrical characteristics of said simulated target comprises switch means for changing the length of said electrical conductor means.

* * * * *